United States Patent [19]

Yoshinari

[11] 4,453,496

[45] Jun. 12, 1984

[54] MULTITUBULAR ONCE-THROUGH BOILER

[75] Inventor: Yuji Yoshinari, Hojo, Japan

[73] Assignee: Miura Co., Ltd., Matsuyama, Japan

[21] Appl. No.: 403,521

[22] Filed: Jul. 30, 1982

[30] Foreign Application Priority Data

Aug. 1, 1981 [JP] Japan ..... 56-121084

[51] Int. Cl.[3] ..... F22B 7/00

[52] U.S. Cl. ..... 122/6 A; 122/13 R; 122/155 A; 122/235 A; 165/156; 165/180

[58] Field of Search ..... 122/13 R, 6 A, 18, 16, 122/135 F, 155 A, 153, 235 A, 235 F; 165/180, 160, 133, DIG. 11

[56] References Cited

U.S. PATENT DOCUMENTS

| | | | |
|---|---|---|---|
| 1,944,817 | 1/1934 | Thomas | 122/13 R |
| 3,170,512 | 2/1965 | Smith | 165/180 |
| 3,311,091 | 3/1967 | Kollerup | 122/6 A |
| 3,566,615 | 3/1971 | Roeder, Jr. | 165/156 |
| 3,838,665 | 10/1974 | Astrom | 122/6 A |
| 4,168,743 | 9/1979 | Arai et al. | 165/180 |
| 4,344,388 | 8/1982 | Stevens | 122/6 A |
| 4,356,794 | 11/1982 | Bowman et al. | 122/155 A |
| 4,387,669 | 6/1983 | Brown | 122/235 A |

FOREIGN PATENT DOCUMENTS

| | | |
|---|---|---|
| 5654401 | 10/1972 | Japan . |
| 5343921 | 4/1976 | Japan . |
| 5731703 | 8/1980 | Japan . |
| 56-50829 | 4/1981 | Japan . |

*Primary Examiner*—Henry C. Yuen

*Attorney, Agent, or Firm*—Benasutti and Murray

[57] ABSTRACT

A multitubular once-through boiler which exhibits an excellent heat transfer efficiency and requires a relatively smaller installation area. The multitubular once-through boiler comprises a combustion device, a ring-shaped upper header which functions as a vapor chamber, a ring-shaped lower header which functions as a water chamber, a plurality of vertical water-tubes connecting the upper and lower headers to form a single-row ring-shaped water-tube wall, a combustion chamber which is a cylindrical inner space surrounded by the water-tube wall, and a ring-shaped combustion gas passage formed between the water tube wall and an outer wall of the boiler. The water-tubes each has a spiral channel grooved on the surface thereof and is in contact with adjacent water-tubes. The area next to each two adjacent water-tubes, on the side of the tubes facing the outer wall of the boiler, has a barrier plate disposed in contact with the water tubes. The barrier plate has an approximately V-shaped cross-section corresponding to the configuration of said area.

The multitubular once-through boiler may further comprises a partition wall for dividing the cylindrical inner space of the water-tube wall into the combustion chamber and a flue.

9 Claims, 11 Drawing Figures

MULTITUBULAR ONCE-THROUGH BOILER

BACKGROUND OF THE INVENTION

1. Field of the Invention

This invention relates to a water-tube boiler and, in particular, a multitubular or shell-and-tube type once-through boiler in which a pair of upper and lower headers are connected by means of a plurality of vertical water-tubes communicating therewith. The once-through boiler according to this invention has a simple structure, exhibits excellent heat transfer efficiency, and requires only a relatively small installation area.

2. Description of the Prior Art

A variety of multitubular once-through boilers have been described in past patent and other technical literatures. Most of these well-known once-through boilers comprise a burner, a pair of ring-shaped upper and lower headers, and a plurality of vertical water-tubes connecting the upper and lower headers, the water-tubes being in contact with each other to form a ring-shaped water-tube wall. However, multitubular once-through boilers of this type have drawbacks such as insufficient heat transfer area per unit volume and a remarkably large installation area, since their water-tubes are blank pipes.

To overcome the above drawbacks, many attempts have been made to improve the water-tubes in the boilers. One approach has been to dispose the water-tubes a slight distance from each other and to fix to each a longitudinal fin extending along approximately the whole length thereof (see Japanese Examined Utility Model Publication No. 56-54401, published on Dec. 18, 1981, which corresponds to Japanese Utility Model Application No. 47-119115 filed on Oct. 13, 1972 in the name of Miura Co., Ltd.). Another approach, one of the present inventor, has been to dispose the water-tubes a slight distance from each other and to dispose at the area next to each two adjacent water-tubes, on the side of the tubes facing the outer wall or shell of the boiler, a barrier plate having an approximately V-shaped cross-section corresponding to the configuration of said area, the barrier plate being disposed to provide a small clearance with the surface of the water-tubes (see Japanese Examined Utility Model Publication No. 53-43921, published on Oct. 21, 1978, which corresponds to Japanese Utility Model Application No. 51-43496 filed on Apr. 7, 1976 in the name of Miura Co., Ltd.). These approaches effectively increase the heat transfer efficiency of the boiler, but cannot fully and sufficiently solve the problems set forth above.

SUMMARY OF THE INVENTION

This invention provides a multitubular once-through boiler comprising the means of:

- a combustion device such as a gas burner or oil burner;
- a ring-shaped upper header which functions as a vapor chamber;
- a ring-shaped lower header which functions as a water chamber;
- a plurality of vertical water-tubes connecting the upper and lower headers to form a single-row ring-shaped water-tube wall;
- a combustion chamber which is a cylindrical inner space surrounded by the water-tube wall; and
- a ring-shaped passage for combustion gas formed between the water-tube wall and an outer wall or shell of the boiler; said boiler being characterized in that said water-tubes each has a spiral channel grooved on the surface thereof and is in contact with adjacent water-tubes and that the area next to each two adjacent water-tubes, on the side of the tubes facing the outer wall of the boiler, has a barrier plate disposed in contact with the water-tubes, said barrier plate having an approximately V-shaped cross-section corresponding to the configuration of said area.

In a preferred embodiment, the multitubular once-through boiler according to this invention may further comprise a partition wall for dividing the cylindrical inner space surrounded by the water-tube wall to form both the combustion chamber and a flue, the partition wall extending horizontally within said cylindrical inner space. For example, if the combustion device is disposed in a central opening of the upper header, the partition wall can be disposed in a lower position of said cylindrical inner space to form an upper major chamber comprising the combustion chamber and a lower minor chamber comprising the flue. If the combustion device is disposed in a central opening of the lower header, the partition wall can be disposed in an upper position of said cylindrical inner space to form an upper minor chamber comprising the flue and a lower major chamber comprising the combustion chamber.

The term "in contact with" as used herein with regard to the arrangement of two adjacent water-tubes or the barrier plate and water-tubes is intended to mean that they can be put in contact with each other immediately or with a very small clearance substantially equivalent to bring put in contact with each other. It is therefore to be noted that while this invention is further described hereinafter with regard to the former arrangement, the latter arrangement is also applicable to this invention, if desired.

According to this invention, there can be provided an easily constructable, multitubular once-through boiler which has a small installation area and also good heat transfer efficiency. This is because the once-through boiler is constituted so that each of the vertical water-tubes has a spiral channel grooved on the surface thereof and is in contact with adjacent water-tubes and so that the area next to each two adjacent water-tubes, on the side of the tubes facing the outer wall or shell of the boiler, has an approximately V-shaped barrier plate effective as a heat transfer accelerator.

This invention and its objects and advantages will become more apparent by referring to the accompanying drawings and to the ensuing detailed description of the preferred embodiments, which follows.

DETAILED DESCRIPTION OF THE INVENTION

This invention will be further described in more detail with reference to the accompanying drawings.

Figure 1:
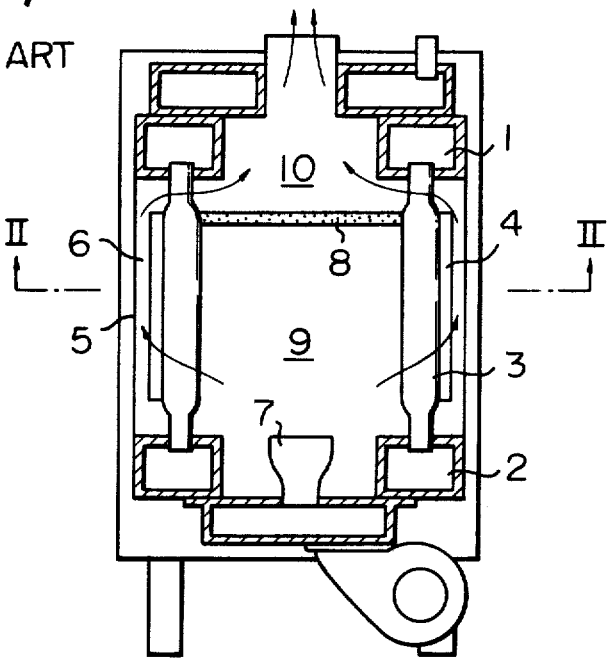
Fig. 1 PRIOR ART
FIG. 1 is a longitudinal cross-sectional view of a water-tube boiler according to Japanese Examined Utility Model Publication No. 56-54401.

Referring now to FIG. 1, there is illustrated an example of the prior water-tube boilers in which a plurality of vertical water-tubes are disposed to form a ring-shaped water-tube wall. The illustrated boiler comprises a pair of ring-shaped headers, namely, upper header 1, which is a vapor chamber, and lower header 2, which is a water chamber. These upper and lower headers are connected through a plurality of vertical water-tubes 3 thereby forming a single-row ring-shaped vertical water-tube wall. Reference numeral 4 is a fin attached to each of water-tubes 3.

Figure 2:
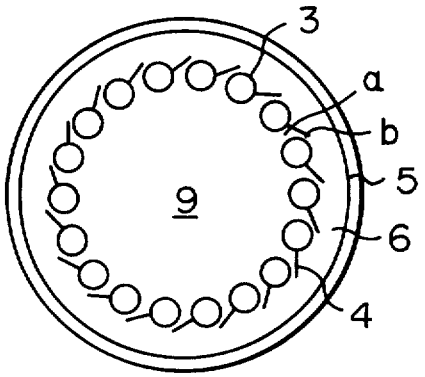
Fig. 2 PRIOR ART
FIG. 2 is a cross-sectional view of the boiler taken along line II—II of FIG. 1.

The formation of the ring-shaped water-tube wall will be easily understood from FIG. 2, which is a cross-sectional view of the boiler taken along line II—II of FIG. 1. As shown, gap a between each two adjacent water-tubes 3 is very narrow. Further, each of water-tubes 3 has fin 4 attached thereto. Fins 4 extend longitudinally along approximately the whole lengths of the water-tubes and project into combustion gas passage 6 formed between the water-tube wall and outer wall 5 of the boiler. Gap b between fins 4 and the surface of water-tubes 3 is also very narrow. Preferably, its size is substantially the same as that of gap a.

Referring again to FIG. 1, burner 7 is disposed in a central opening of lower header 2. Further, partition wall 8 extends horizontally in the cylindrical inner space surrounded by the water-tube wall and divides it into two upper and lower chambers, namely, combustion chamber 9 and flue 10.

The combustion gas produced in combustion chamber 9 is first heat exchanged with the boiler water of vertical water-tubes 3 through radiation heat transfer. Then, as is shown by the arrows in FIG. 1, the combustion gas is laterally passed first through narrow gap a formed between each two adjacent water-tubes 3 and then narrow gap b formed between fins 4 of each water-tube 3 and the surface of each adjacent water-tube 3. After reaching gas passage 6, the combustion gas flows upward and is introduced into flue 10 (the flow direction of the combustion gas is shown in arrows). The combustion gas in flue 10 is then discharged from a smokestack (not shown).

Figure 3:
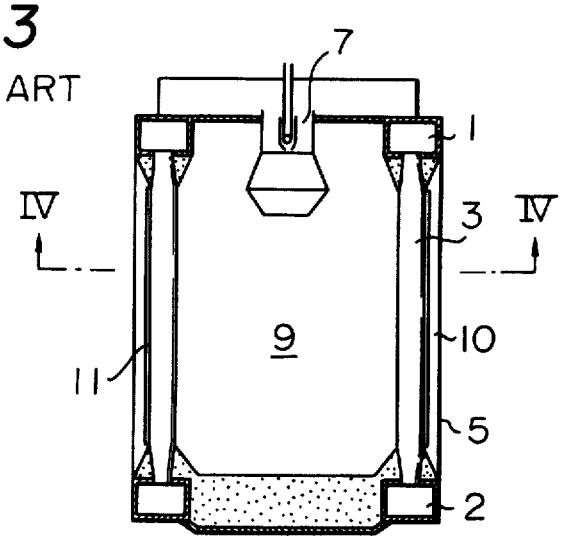
Fig. 3 PRIOR ART
FIG. 3 is a longitudinal cross-sectional view of a once-through boiler of vertical water-tube type according to Japanese Examined Utility Model Publication No. 53-43921.
Figure 4:
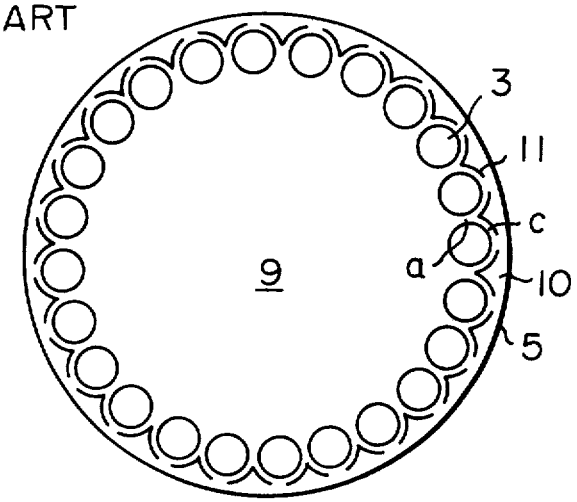
Fig. 4 PRIOR ART
FIG. 4 is a cross-sectional view of the boiler taken along line IV—IV of FIG. 3.
Figure 5:
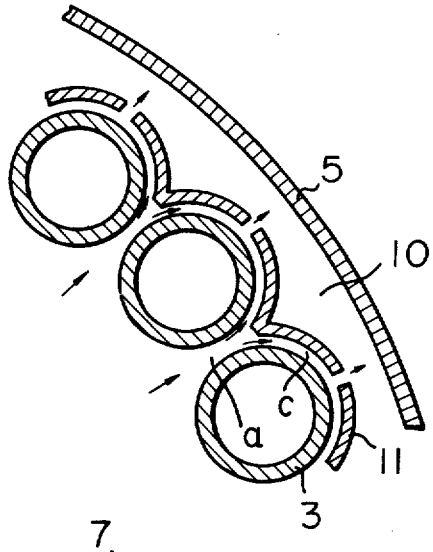
Fig. 5 PRIOR ART
FIG. 5 is an enlarged schematic drawing showing a part of the water-tube wall of FIG. 4.

Another example of the prior once-through water-tube boilers can be found in FIGS. 3, 4, and 5. As illustrated in FIG. 3, the boiler comprises upper ring-shaped vapor chamber 1, lower ring-shaped water chamber 2, and a plurality of vertical water-tubes connecting said upper and lower chambers. Reference numeral 7 is a burner disposed in a central opening of vapor chamber 1.

FIG. 4 is a cross-sectional view of the boiler taken along line IV—IV of FIG. 3 and shows an arrangement of the water-tubes. Water-tubes 3 are disposed in the boiler in the form of a ring-shaped water-tube wall having very narrow gaps a (about 1 mm). The cylindrical inner space surrounded by the water-tube wall constitutes combustion chamber 9, and the ring-shaped space formed between the water-tube wall and outer wall 5 constitutes flue 10. The illustrated boiler is characterized in that all of the areas next to each two adjacent water-tubes 3, on the side of the tubes facing outer wall 5 of the boiler, have approximately V-shaped heat transfer accelerating covers 11 disposed to provide small clearance c (about 1 mm) with the surface of the water-tubes 3.

The combustion gas produced in combustion chamber 9 is first heat exchanged with the boiler water of water-tubes 3 as a function of radiation heat transfer. Thereafter, the gas, as is shown in FIG. 5, is passed through gaps a of each two adjacent water-tubes 3 under convection heat transfer conditions. This is effective to attain further heat exchange. The combustion gas is then passed through gaps c in order to attain further heat exchange with the boiler water. The gas is finally introduced into flue 10 and discharged from a smokestack (not shown) connected thereto.

Figure 6:
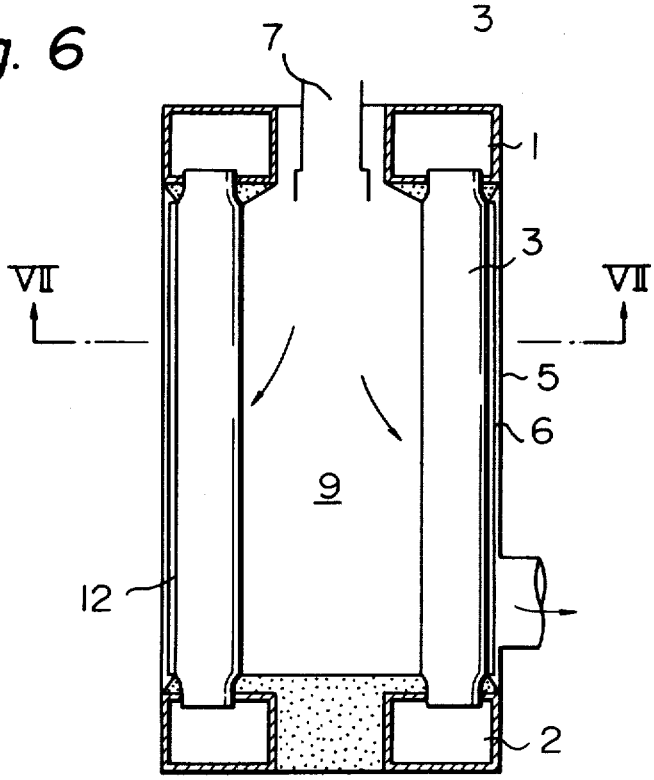
FIG. 6 is a longitudinal cross-sectional view of a multitubular once-through boiler according to one preferred embodiment of this invention.

FIG. 6 shows a multitubular once-through boiler according to one preferred embodiment of this invention. The boiler comprises ring-shaped upper header 1 which functions as a vapor chamber and ring-shaped lower header 2 which functions as a water chamber. Reference numeral 7 is a burner disposed in a central opening of upper header 1. Alternatively, burner 7 may be disposed in a central opening of lower header 2. Combustion chamber 9 is a cylindrical inner space surrounded by a vertical water-tube wall, namely, a ring-shaped arrangement of a plurality of vertical water-tubes 3 connecting upper and lower headers 1 and 2. The formation of the water-tube wall will be easily understood from FIG. 7, which is a cross-sectional view of the boiler taken along line VII—VII of FIG. 6.

Figure 7:
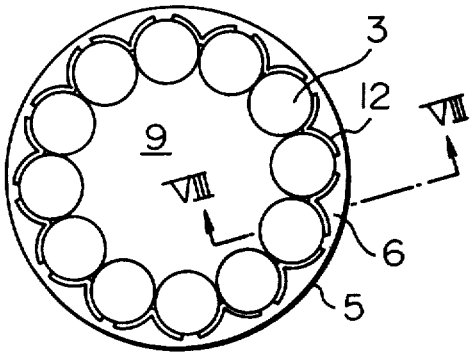
FIG. 7 is a cross-sectional view of the boiler taken along line VII—VII of FIG. 6.

As shown in FIG. 7, water-tubes 3 are arranged in contact with each other so as to form a continuous, circular water-tube wall. The water-tube wall and outer wall 5 of the boiler form ring-shaped passage 6 for the combustion gas.

Figure 8:
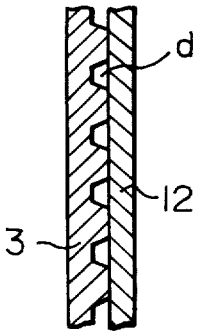
FIG. 8 is an enlarged longitudinal cross-sectional view of the water-tube taken along line VIII—VIII of FIG. 7.

In the once-through boiler of this invention, water-tubes 3 each has spiral channel d grooved on the surface thereof (FIG. 8). Channel d is used as a conduit for effecting heat exchange between the combustion gas and boiler water, as is described hereinafter. In order to avoid intermeshing of the channels of adjacent water-tubes, each water-tube should have a channel pitch different from the adjacent tubes. Alternatively, it is desirable that the each two adjacent water-tubes have their channels grooved in opposite directions. If desired, the water-tubes may have a circumferentially grooved channel in place of the spiral channel.

Figure 9:
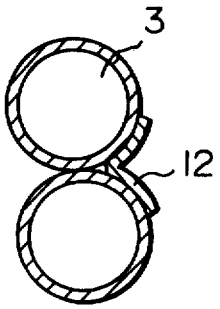
FIG. 9 is an enlarged schematic drawing showing a part of the water-tube wall of FIG. 7.

Further, as shown in FIG. 9, the area next to each two adjacent water-tubes 3, on the side of the tubes facing the outer wall (not shown) of the boiler, has barrier plate 12 disposed in contact with water tubes 3. Barrier plate 12 has an approximately V-shaped cross-section corresponding to the configuration of said area and is effective to accelerate heat transfer from the combustion gas to the boiler water. Barrier plate 12 should be in contact with the surface of the water-tubes 3 in order to insure an excellent acceleration effect. The length of barrier plate 12 is substantially the same as that of water-tubes 3.

Referring again to FIG. 6, the combustion gas produced in combustion chamber 9 is first heat exchanged with the boiler water of water tubes 3 through radiation heat transfer. Then, the gas is guided through the gaps formed between water-tubes 3 and barrier plates 12, namely, channels d of water-tubes 3. While passing through channels d, the combustion gas is heat exchanged with the boiler water. The gas is then introduced into combustion gas passage 6 and is finally discharged into the air through a smokestack (not shown) connected to outer wall 5 of the boiler.

Figure 10:
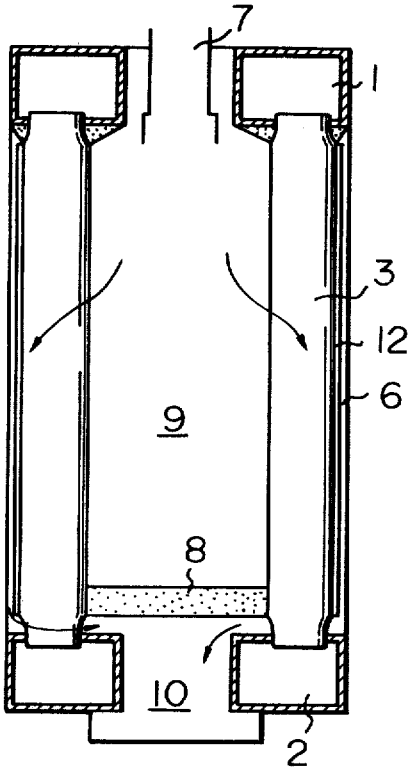
FIG. 10 is a longitudinal cross-sectional view of a multitubular once-through boiler according to another preferred embodiment of this invention.

Another preferred embodiment of the multitubular once-through boiler according to this invention can be found in FIG. 10. The illustrated boiler is substantially similar to that of FIG. 6 except that it further comprises partition wall 8 which extends horizontally in the cylindrical inner space surrounded by the vertical water-tube wall and which divides the inner space into upper combustion chamber 9 and lower flue 10.

The combustion gas produced in combustion chamber 9 of FIG. 10 is first heat exchanged with the boiler water of water tubes 3 in the chamber. The heat exchange is effected through radiation heat transfer. The combustion gas is then heat exchanged with the boiler water while passing through channels (not shown) formed between water-tubes 3 and barrier plates 12. After completion of the heat exchange at the channels, the gas is introduced into passage 6, guided to flue 10 through gaps of adjacent water-tubes 3, and finally discharged into the air from a smokestack (not shown) of flue 10.

Figure 11:
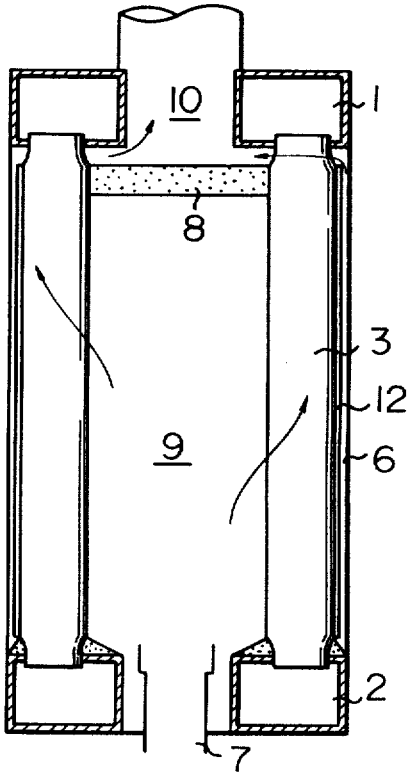
FIG. 11 is a longitudinal cross-sectional view of a multitubular once-through boiler according to still another preferred embodiment of this invention.

The multitubular once-through boiler shown in FIG. 11 is a modification of the boiler of FIG. 10. In the illustrated boiler, burner 7 is positioned in a central opening of lower header 2. Partition wall 8 for dividing the cylindrical inner space of the water-tube wall into upper flue 10 and lower combustion chamber 9 is positioned in an upper area of said cylindrical inner space and extends horizontally therein.

In the once-through boiler of FIG. 11, the combustion gas produced in combustion chamber 9 is first heat exchanged with the boiler water of water tubes 3 within the chamber and is then heat exchanged with the boiler water while passing through channels (not shown) grooved on water-tubes 3 as in FIG. 10. After heat exchange at the channels, the combustion gas is introduced into passage 6, guided to flue 10, and finally discharged into the air from a smokestack (not shown) of flue 10.

This invention has been described in detail with particular reference to certain preferred embodiments thereof, but it will be understood that variations and modifications can be effected within the spirit and scope of this invention.

I claim:

1. A multitubular once-through boiler comprising:
- a ring-shaped upper header;
- a ring-shaped lower header;
- a plurality of water-tubes connecting the upper and lower headers and combining to form a water-tube wall, wherein outer surfaces of said water-tubes have a spiral channel grooved therein;
- a combustion chamber surrounded by the water-tube wall;
- a combustion device associated with the combustion chamber;
- a ring-shaped passage formed between the water-tube wall and an outer wall of the boiler; and
- a plurality of barrier plates positioned on the side of the water-tubes facing the outer wall of the boiler, wherein said barrier plates have an essentially V-shaped cross-section corresponding to the configuration of adjacent pairs of water-tubes;
- wherein the outer surfaces of the water-tubes have exposed portions which are in contact with adjacent water-tubes, and covered portions which are in contact with adjacent barrier plates.

2. A multitubular once-through boiler according to claim 1, wherein said water-tube wall defines a generally cylindrical inner space, and which further comprises a partition wall for dividing said cylindrical inner space into the combustion chamber and a flue, said partition wall extending horizontally within said cylindrical inner space.

3. A multitubular once-through boiler according to claim 2, in which said combustion device is disposed in a central opening of said upper header, while said partition wall is disposed in a lower position of said cylindrical inner space to form a major upper combustion chamber and a minor lower flue.

4. A multitubular once-through boiler according to claim 2, in which said combustion device is disposed in a central opening of said lower header, while said partition wall is disposed in an upper position of said cylindrical inner space to form a minor upper flue and a major lower combustion chamber.

5. A multitubular once-through boiler comprising:
- a ring-shaped upper header;
- a ring-shaped lower header;
- a plurality of water-tubes connecting the upper and lower headers, wherein outer surfaces of said water-tubes have a spiral channel grooved therein and are in contact with outer surfaces of adjacent water-tubes to form a water-tube wall;
- a combustion chamber surrounded by the water-tube wall;
- a combustion device associated with the combustion chamber;
- a ring-shaped passage formed between the water-tube wall and an outer wall of the boiler; and
- a plurality of barrier plates in contact with adjacent pairs of water-tubes, on the side of the water-tubes facing the outer wall of the boiler, wherein said barrier plates have an essentially V-shaped cross-section corresponding to the configuration of the contacted water-tubes.

6. A multitubular once-through boiler according to claim 5, wherein the pitch of the channel grooved in one water-tube differs from the pitch of the channels grooved in adjacent water-tubes which it contacts.

7. A multitubular once-through boiler according to claim 5, wherein adjacent water-tubes have channels grooved in opposite directions.

8. A multitubular once-through boiler according to claim 5, wherein essentially the entire surface of the barrier plate contacting the water-tubes is in contact with the surface of the water-tubes.

9. A multitubular once-through boiler according to claim 5, wherein the barrier plates have a length substantially the same as the water-tubes.

* * * * *